US005190194A

United States Patent [19]

Rosner et al.

[11] Patent Number: 5,190,194

[45] Date of Patent: Mar. 2, 1993

[54] RECREATIONAL INNER-TUBE ACCESSORY

[76] Inventors: Paul Rosner; Barry Canter, both of 322 S. Laurel St., Richmond, Va. 23220

[21] Appl. No.: 836,696

[22] Filed: Feb. 18, 1992

[51] Int. Cl.[5] ..... A45C 11/00

[52] U.S. Cl. ..... 224/0.5; 441/131

[58] Field of Search ..... 224/42.45 R, 42.26, 224/42.38, 42.39, 0.5; 297/188; D21/238; 441/35, 40, 42, 130, 131, 132; 114/188, 270; 220/560, 737, 23.83; 206/315.1, 446, 216; 248/311.2, 314

[56] References Cited

U.S. PATENT DOCUMENTS

| | | | |
|---|---|---|---|
| 1,764,852 | 6/1930 | Phillips | 441/131 |
| 2,253,936 | 8/1941 | Karst | 441/131 |
| 2,529,961 | 11/1950 | Phillips | 441/131 |
| 2,974,331 | 3/1961 | Dize | 441/130 X |
| 3,533,529 | 10/1970 | Helbig | 220/560 X |
| 3,748,672 | 7/1973 | Patrick et al. | 441/131 |
| 4,799,910 | 1/1989 | Kellough | 441/130 X |
| 4,861,301 | 8/1989 | Pomeroy et al. | 441/131 |
| 4,887,716 | 12/1989 | Abraham | 220/560 X |
| 5,046,978 | 9/1991 | Howerten | 441/131 |
| 5,115,939 | 5/1992 | Porter | 220/705 |

*Primary Examiner*—Henry J. Recla
*Assistant Examiner*—Glenn T. Barrett
*Attorney, Agent, or Firm*—Norman B. Rainer

[57] ABSTRACT

A device for attachment to an inflated recreational inner tube has two spaced apart resilient arms that substantially encircle the tube. A horizontal mounting panel, arcuately shaped to conform to the circular outer perimeter of the tube, extends between the two arms. An umbrella-holding receptacle is vertically affixed to the mounting panel. Also affixed to the mounting panel are a beverage-holding receptacle and a waterproof utility container.

5 Claims, 1 Drawing Sheet

RECREATIONAL INNER-TUBE ACCESSORY

BACKGROUND OF THE INVENTION

1. Field of the Invention

This invention relates to recreational floatation devices and more particularly concerns an umbrella holder and accessory caddy adapted to be fastened to an inflated inner-tube.

2. Description of the Prior Art

Numerous recreational inner-tube accessories have been disclosed for providing a more pleasurable recreational float tube. Many devices have been disclosed to provide more comfortable and secure seating within an inner tube. For example, U.S. Pat. No. 2,529,961 to R. A. Phillips discloses an integral cover and seat adapted to be laced upon an inflatable tube, thereby providing a safety device for hunters and fishermen. The device is carried by the sportsmen on suspenders in anticipation of use. The cover may be equipped with one or more pockets, presumably for the storage of fishing lures or ammunition. More recent commercially available models of this type of device are commonly referred to as "belly boats" and differ in that waders are integral with the tube cover, thereby keeping the sportsman dry as well as afloat. U.S. Pat. No. 2,253,936 to Karst discloses an aquatic amusement vehicle comprised of a framework supported by a multiplicity of floating tubes. This device encompasses steering and propulsion means as well as seating and a game playing surface.

U.S. Pat. No. 1,764,852 to T. Phillips discloses a rigid seat adapted to be strapped within the center of an inner tube. The seat may be equipped with sunshade holding means. However, this device requires the use of the rigid seat in order to support the sunshade. It is apparent that such a device would be relatively expensive and not quickly attached to an inner tube. Furthermore, this device requires that the user float in a vertical disposition with legs straddling the seat. The vertical position may be quite uncomfortable for prolonged float trips, and dangerous in shallow rivers.

U.S. Pat. No. 3,748,672 to Patrick, et al. discloses yet another rigid seat adapted to be strapped within the center of an inner tube. This device may be adapted to have an umbrella holder bracket embraced by one of the straps. Although the Patrick seat is adapted to accommodate the user in a reclined position, the attachment of the seat with multiple straps creates a relatively expensive and time consuming umbrella mount. Moreover, neither the T. Phillips or the Patrick, et al, patents disclose storage receptacles for valuables, sunscreen, canned beverages, etc.

U.S. Pat. No. 4,861,301 to Pomeroy et al. discloses a beverage-containing insulated cooler adapted to be strapped to the outside of an inner tube. It is comprised of a cloth sack containing a rigid cooler. However, this device has no beverage holding receptacle or umbrella holder.

It is accordingly an object of the present invention to provide an accessory receptacle device which may be quickly and easily attached to an inflatable inner tube.

It is another object of the present invention to provide a receptacle of the aforesaid nature which will maintain an extended and deployed umbrella in overlying juxtaposition above the inner tube.

It is a further object of this invention to provide a receptacle device of the aforesaid nature which has means for holding an open beverage container in upright disposition.

It is yet another object of this invention to provide a receptacle device of the aforesaid nature which is durable, adaptable to fit most inner tubes, and amenable to low cost manufacture.

These objects and other objects and advantages of the invention will be apparent from the following description.

SUMMARY OF THE INVENTION

The above and other beneficial objects and advantages are accomplished in accordance with the present invention by an accessory holder device adapted to embracingly engage an inflated torus-shaped inner tube having a circular outer perimeter and an interior circular perimeter which defines a central region, said device comprised of:

a) a horizontal mounting panel elongated between paired extremities and arcuately shaped to match the contour of the outer perimeter of the tube, b) paired vertically disposed resilient holding arms emergent from said paired extremities as continuous integral extensions of said mounting panel and circularly shaped to encircle at least 270 degrees of said tube in tight-fitting engagement therewith, c) a cylindrical umbrella-holding receptacle vertically affixed to said mounting panel adjacent the midpoint thereof and adapted to accept an umbrella handle in close conformity therewith, d) a cylindrical beverage holding receptacle tangentially affixed to said mounting panel in vertical disposition and having upper and lower extremities and a closure panel fixedly associated with said lower extremity, said upper extremity adapted to receive a beverage container in close conformity therewith, and e) a utility container affixed to said mounting panel and having a hingedly associated lid, said lid having fastening means adapted to secure said lid in a closed position.

In a preferred embodiment, the umbrella holding receptacle may be provided with a transversely mounted setscrew adapted to secure the umbrella within the receptacle.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
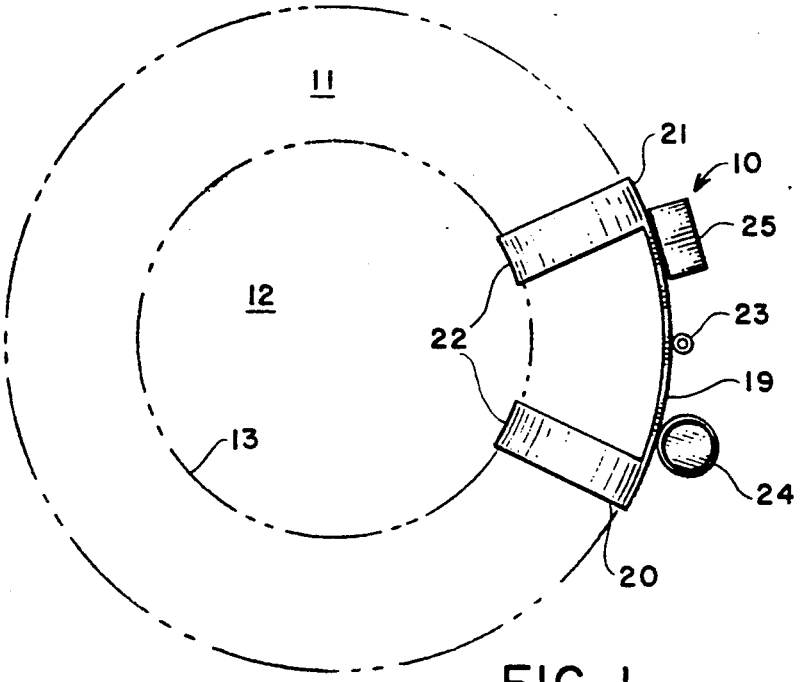
FIG. 1 is a top view of an embodiment of the accessory holding device of the present invention shown in functional emplacement upon an inflated inner tube.
Figure 2:
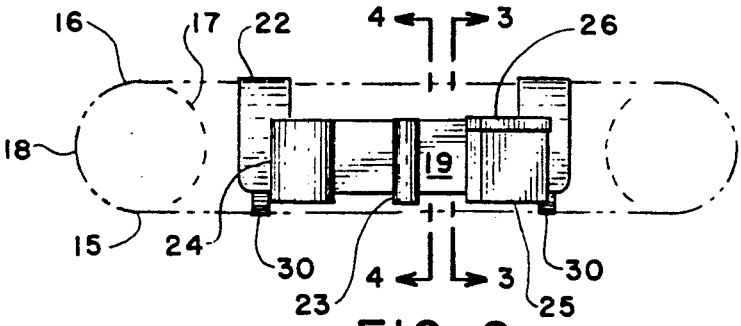
FIG. 2 is a side view of the embodiment of FIG. 1.
Figure 3:
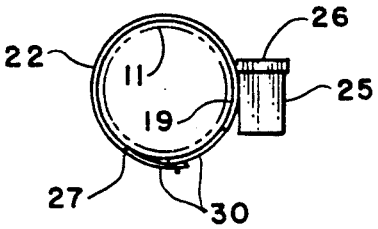
FIG. 3 is a sectional view taken in the direction of the arrows upon line 3—3 of FIG. 2.
Figure 4:
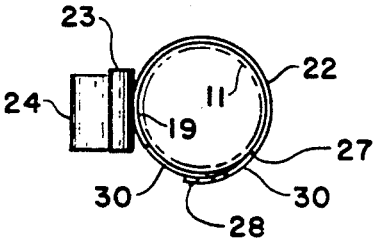
FIG. 4 is a sectional view taken in the direction of the arrows upon line 4—4 of FIG. 2.

Referring to FIGS. 1–4, an embodiment of the accessory holder device 10 of the present invention is shown mounted upon an inflated rubber inner tube 11 having central region 12 defined by circular interior perimeter 13.

The holder device 10, in association with inner tube 11 provides a recreational vehicle for supporting a rider on bodies of water and particularly for floating down rapidly moving bodies of water such as rivers.

Inner tube 11 is of torus-shape, as used in automobile tires. The tube, generally made of a rubber composition, is available in a variety of sizes depending upon the dictates of the particular need of the automobile tire. The most common sizes of inner tubes have an inner diameter that varies between 20 and 22 inches.

The section diameter of tube 11 is frequently referred to as the thickness of the inflated tube. When inflated, as shown in FIGS. 1–4, the tube will generally assume a uniform cross-section with a relatively small amount of positive pressure on the interior thereof. The torus surface may be divided for purpose of illustration into a bottom surface 15 along the lower arc of the tube, a top surface 16 along the upper arc of the tube, an inner surface 17 on the inside of the tube defined by central region 12, and an outer surface 18. The bottom surface 15 is submerged below the water surface when the vehicle is afloat.

The device 10 is comprised of a horizontal mounting panel 19 elongated between paired extremities 20 and 21. Said mounting panel is arcuately shaped to fit the curvature of outer surface 18 of the tube.

Paired vertically disposed resilient holding arms 22 are emergent from mounting panel at said extremities as continuous integral extensions of the mounting panel. Said holding arms are circularly shaped so as to extend at least 270 degrees around the tube in a substantially vertical plane. Said holding arms have a width of between about 1½ and 4 inches, and are preferably formed of a resilient type of plastic, causing said arms to tightly grip the tube.

A cylindrical umbrella-holding receptacle 23 having an open upper extremity and closed bottom extremity is vertically affixed to mounting panel 19 adjacent the midpoint thereof. Said receptacle is configured to securely hold the handle of an umbrella.

A cylindrical beverage-holding receptacle 24 having an open upper extremity and closed bottom extremity is vertically affixed to mounting panel 19 adjacent an extremity thereof. Receptacle 24 is configured to securely confine a beverage container.

A utility container 25 having a hinged lid 26 is affixed to mounting panel 19 adjacent an extremity opposite from the extremity associated with beverage-holding receptacle 24. Lid 26 is adapted to be secured in a closed position by conventional means such as snap fasteners, levered buckles, or hook and loop fastener material. Container 25 is preferably capable of watertight closure, and may be provided with sealing O-rings that interact with the lid.

Horizontal mounting panel 19, holding arms 22, holder receptacles 23 and 24, and container 25 may be portions of a single monolithic piece of plastic, having been fabricated by a molding operation. Suitable plastics which may be employed include ABS and engineering grades of plastics such as polyester, polycarbonates, polyamides and polyacetal. The dimensions of the device, especially its thickness, which may range from 3 to 7 mm, are such as to permit resilient deformation. Holding arms 22 preferably exert compressive gripping force upon the tube. In some embodiments, additional securing means may be employed in the form of straps 30 which adjustably join the distal extremity 27 of each holding arm to the lower extremity of mounting panel 19. The adjustability of such straps may be achieved with a buckle or Velcro hook and loop attachment means. Alternatively, straps 30 may be in the form of an apertured strip and an interactive strip having a locking tab 28 that engages a desired aperture in the other strip. Such adjustable strap mechanism is frequently employed as the headband of caps employed as wearing apparel.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. An accessory holder device adapted to embracingly engage an inflated torus-shaped inner tube having a circular outer perimeter with a contour and an interior circular perimeter which defines a central region, said device comprised of:

a) a horizontal elongated mounting panel having a pair of spaced extremities, said panel being arcuately shaped and adapted to match the contour of the outer perimeter of the tube, b) a pair of vertically disposed resilient holding arms extending from said pair of extremities as continuous integral extensions of said mounting panel, wherein one of said pair of holding arms extends from one of said pair of extremities and another of said pair of holding arms extends from another of said pair of extremities, said holding arms being shaped such that said holding arms are adapted to encircle a substantial portion of said tube in tight-fitting engagement therewith, c) a cylindrical umbrella-holding receptacle vertically affixed to said mounting panel and adapted to accept an umbrella handle in close conformity therewith, d) a cylindrical beverage-holding receptacle tangentially affixed to said mounting panel in vertical disposition and having upper and lower extremities and a closure panel fixedly associated with said lower extremity, said receptacle being adapted to receive a beverage container in close conformity therewith, and e) a utility container affixed to said mounting panel and having a hingedly associated lid connected thereto, said lid having fastening means adapted to secure said lid in a closed position.

2. The holder device of claim 1 wherein said umbrella-holding receptable has means adapted to secure the umbrella within said receptacle.

3. The holder device of claim 1 wherein said utility container is waterproof when said lid is in its closed position.

4. The holder device of claim 1 wherein said mounting panel, said pair of holding arms, said holding receptacles and said container are formed as a single monolithic piece of plastic, having been fabricated by a molding operation.

5. The holder device of claim 1 further comprising a plurality of securing straps extending between said arms and mounting panel such that a securing strap extends from each of said pair of holding arms to said mounting panel.

* * * * *